United States Patent [19]

Ford

[11] Patent Number: 4,638,909

[45] Date of Patent: Jan. 27, 1987

[54] CONTAINER FOR RETAINING PAINT

[76] Inventor: Thomas E. Ford, 150-24 6th Ave., Whitestone, N.Y. 11357

[21] Appl. No.: 660,010

[22] Filed: Oct. 11, 1984

Related U.S. Application Data

[63] Continuation of Ser. No. 521,640, Aug. 10, 1983, abandoned, which is a continuation-in-part of Ser. No. 385,019, Jun. 4, 1982, abandoned.

[51] Int. Cl.[4] ..... B65D 21/00; B65D 81/24

[52] U.S. Cl. ..... 206/1.7; 206/205; 220/344; 220/378; 312/31.1

[58] Field of Search ..... 190/11; 206/1.7–1.9, 206/349, 372, 523, 524, 524.1, 524.2, 524.3, 562, 563, 572, 575, 205; 220/215, 378, 444, 902, 20, 344, 358, 357; 312/31.04, 31.1

[56] References Cited

U.S. PATENT DOCUMENTS

| | | | |
|---|---|---|---|
| 1,637,814 | 8/1927 | Gallagher | 312/31.1 |
| 1,641,650 | 9/1927 | Walker | 220/344 |
| 1,665,663 | 4/1928 | Hake | 312/31.1 |
| 1,872,864 | 8/1932 | Yarcho | 220/344 |
| 2,071,169 | 2/1937 | Killik | 206/1.8 |
| 2,271,918 | 2/1942 | Glowka | 220/378 |
| 2,541,525 | 2/1951 | Lewyt | 312/31.1 |
| 2,914,876 | 12/1959 | Osler | 206/1.8 |
| 3,230,290 | 1/1966 | Nelson et al. | 220/378 |
| 3,352,616 | 11/1967 | Linger | 206/1.7 |
| 3,414,343 | 12/1968 | Thomas | 206/1.7 |
| 3,421,679 | 1/1969 | Goldman | 206/523 |
| 3,786,913 | 1/1974 | Crawford | 206/1.8 |
| 3,885,843 | 5/1975 | Rubel | 206/1.7 |
| 3,924,733 | 12/1975 | DeLong | 206/1.8 |
| 4,299,921 | 11/1981 | Youssef | 277/228 |

FOREIGN PATENT DOCUMENTS

| | | | |
|---|---|---|---|
| 0034128 | of 1913 | Sweden | 312/31.1 |

*Primary Examiner*—William Price
*Assistant Examiner*—Jimmy G. Foster
*Attorney, Agent, or Firm*—Gerald Post

[57] ABSTRACT

A container for retaining artist's paints or the like and for preventing same from drying or hardening during storage in the container comprising an open top box including a base and side walls and a cover that can be superposed over the box opening. The underside of the cover includes a resilient gasket of foam rubber or plastic that is located to bear against the edges of the side walls when the box is closed. A thin sheet of polyethylene film is disposed over the gasket to provide an easily cleanable surface and to aid in the conformance of the gasket to side wall edges.

Located within the closed box is a moisture resevoir such as wetted sponge placed in fluid communication with the paints stored in the container.

5 Claims, 6 Drawing Figures

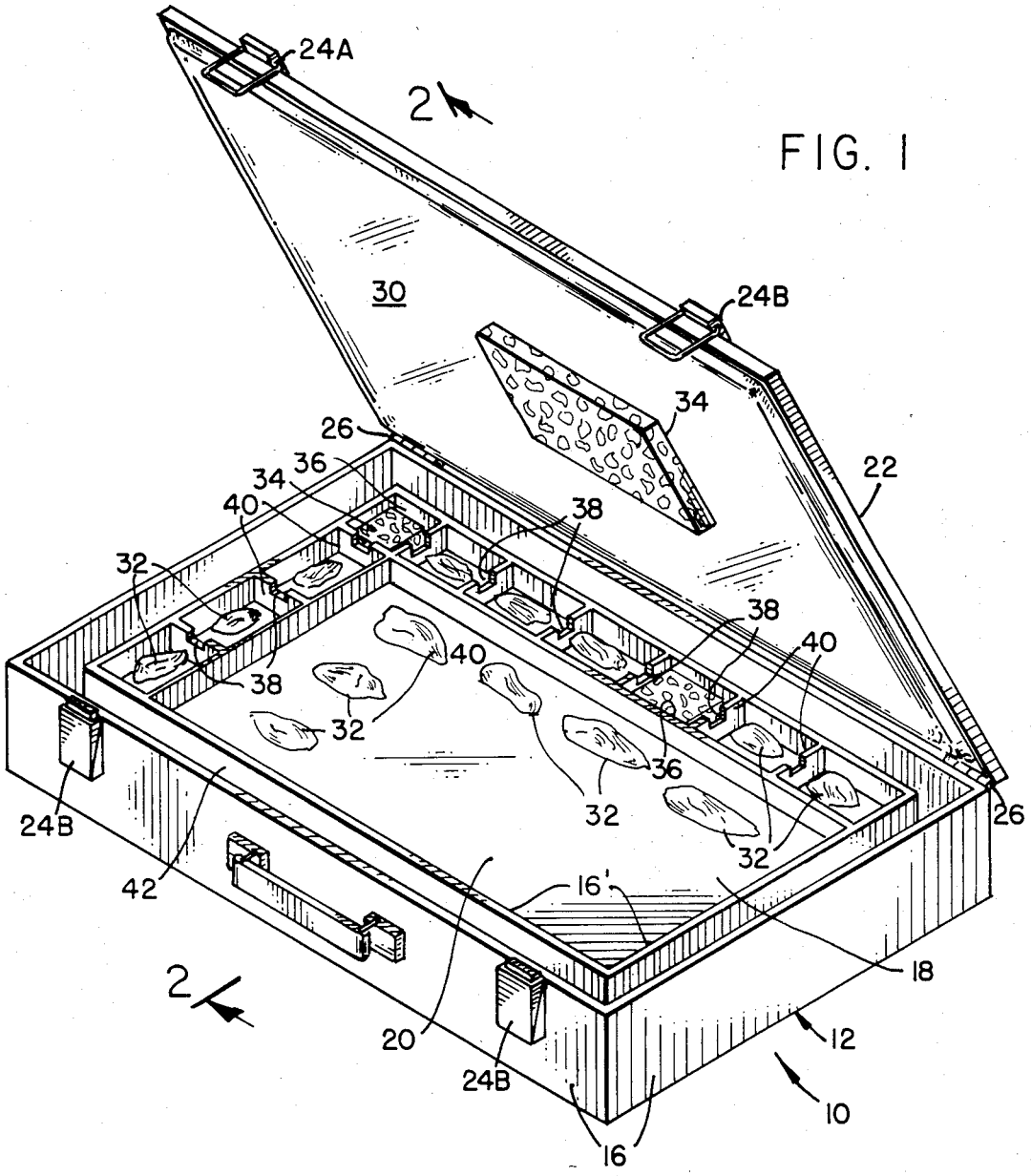
FIG. 1
FIG. 2
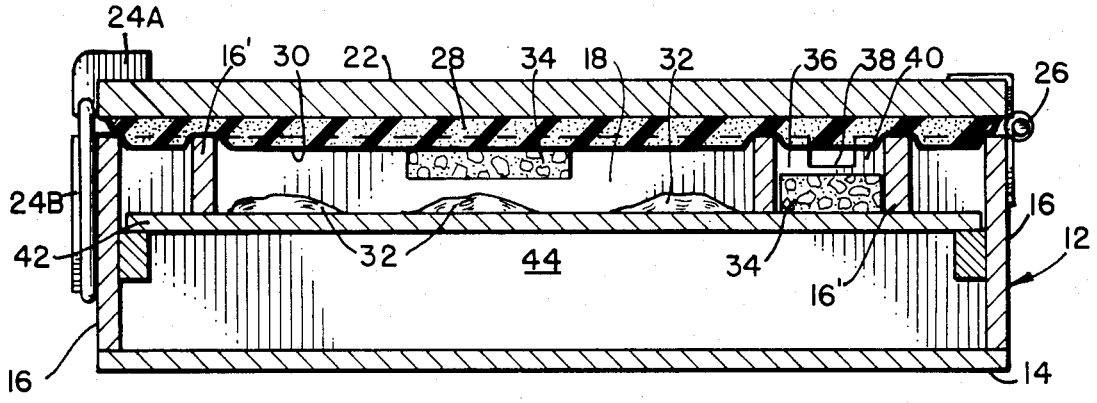

CONTAINER FOR RETAINING PAINT

This is a continuation of application Ser. No. 521,640, filed Aug. 10, 1983, now abandoned, which is a continuation-in-part of application Ser. No. 385,019 filed June 4, 1982, and now abandoned.

BACKGROUND OF THE INVENTION

The present invention relates to containers or boxes for storing paints, particularly artist's painting media, in a substantially air tight chamber to prevent the drying and solidification of the paints.

Oil paints, water colors, tempera and other artist's media are formulated for relatively rapid drying on the painting surface. The rapid drying feature becomes detrimental when paint dries on the pallet or in the compartment before it is applied to the surface. Presently, the artist put out only the relatively small amount of paints he feels will be used to depletion. If they are not all used during the painting session, they will probably have dried before the next session and costly paints are lost since they can only be scraped off and discarded.

SUMMARY OF THE INVENTION

It is the principle object of this invention to provide a paint container that can effectively maintain the paint medium in its most usable state for painting after extended periods of storage.

A further object is to provide a moisture reservoir that would keep the paints in a continuous high moisture ambience to prevent drying.

A still further object is to provide an artist's paint box that can be utilized as a pallet there by allowing the artist to work directly therefrom.

A still further object is to provide a box that will store paints in a removeable jars and prevent the drying of the paints.

A still further object is to provide an easily cleanable surface covering the paints.

These and other objects are achieved by the preferred embodement of the invention in which a box having a removably hinged cover is fitted with a plurality of paint holding compartments. The inner surface of the cover comprises a resilient gasket disposed on the underside thereof. A thin film of polyethylene plastic is stretched over the gasket seal. Upon closure of the box, the resilient under surface conforms to the edges of the box and the partition walls to form airtight seal between the outside air and the compartments within the box.

The exclusion of air from within the box prevents the drying of paints whether it be caused by evaporation of water or the oxidation of the vehicle in oil paints.

Having in mind the above and other objects that would be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjuction with the accompanying drawings.

BRIEF DESCRIPTION OF THE DRAWING

The invention will be described in detail, by way of example, with reference to the accompanying drawings in which:

FIG. 1 is a perspective view of the paint box with the cover in an open position;

FIG. 2 is a sectional view taken along line 2—2 in FIG. 1 illustrating the paint box with the cover in a closed position;

DETAIL DESCRIPTION OF THE PREFERRED EMBODIMENT

Figure 3:
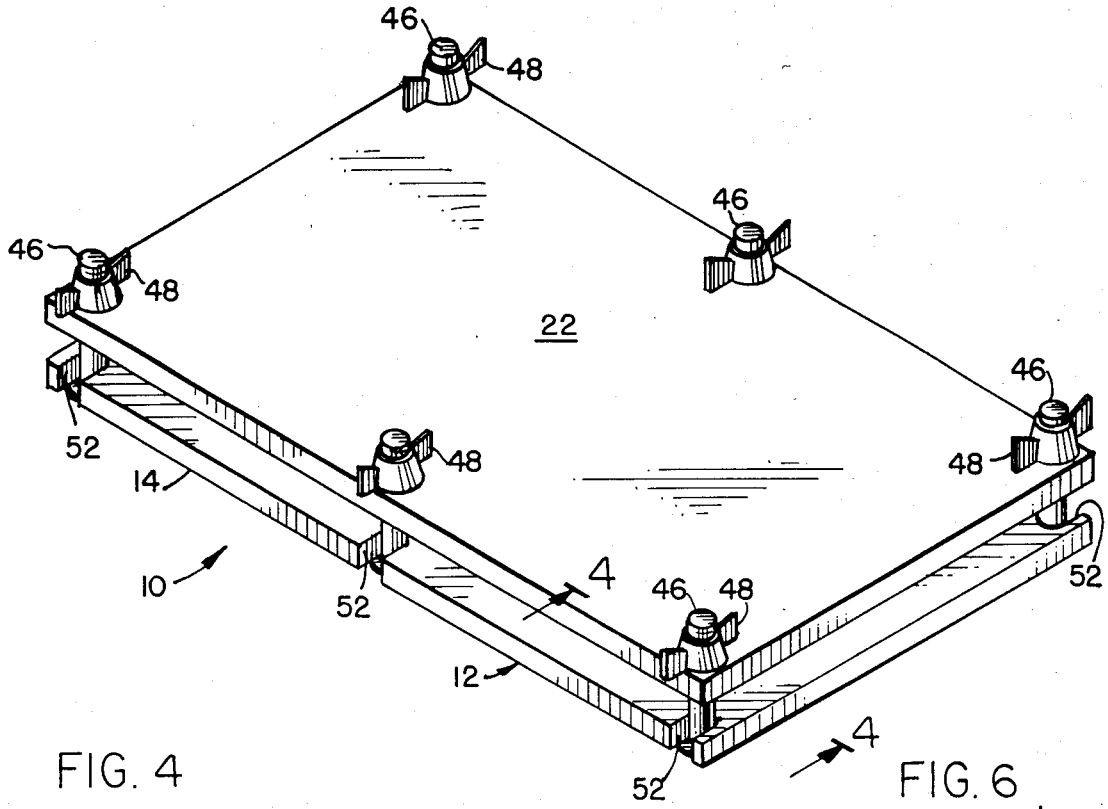
FIG. 3 is a perspective of an alternative embodiment of the invention.

Referring to FIGS. 1 and 2 of the drawing and in accordance with the principles of the invention, an artist's paint box 10 for retaining paints and preventing them from drying or hardening is shown comprising an outer box 12 having a base 14 and vertically disposed side walls 16. At least one paint storage compartment 18 is defined therebetween having an open top 20. A releasably attachable cover 22 is shown in an open position in FIG. 1 and in a closed position in FIG. 2. A pair of latches 24A, 24B serve to hold the cover in the closed position in conjunction with a hinge 26 pivotally connecting the cover 22 with the box 10. In the closed position, the cover 22 superposes the side walls 16 that define the storage compartment 18.

The undersurface of the cover 22 is overlayed, at least in the portions thereof, over lapping the side walls 16, with a gasket 28 of resilient material to form a fluid tight seal therebetween when the cover 22 is disposed in the closed position to compress the gasket 28 thereby preventing the escape of moisture to the outside of the box 10. The retained moisture prevents the stored paints 32 from drying. The gasket 28 can be made from sponge rubber material or a foam plastic.

To provide moisture within the storage compartment 18, a moisture reservoir 34 saturated with water is placed in the storage compartment 18 in fluid communication with the paint 32. The reservoir can be affixed to the underside of the cover 22 or in a reservoir compartment 36 disposed within the box 10 and contains the moisture reservoir 34. The reservoir compartment has notches 38 in at least one of its side walls 40 to open a fluid path to the paint storage compartment. The reservoir is preferably made of a natural sponge or an open celled plastic sponge.

A thin film on non-porous plastic sheeting 30 comprising polyethylene overlays the gasket 28 and the underside of the cover 22. It is utilized to provide an easily cleanable surface that does not adhere to paint, aids in sealing, and keeps paint off the gasket thereby keeping it soft and resilient.

Figure 6:
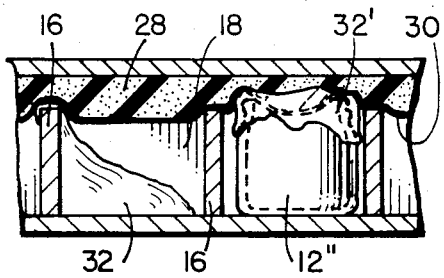
FIG. 6 is a sectional view of a portion of the paintbox.

In a particularly advantageous and preferred embodiment, the necessity for an additional moisture reservoir is eliminated by the surprising discovery that a non-porous film sheeting 30 disposed between the gasket 28 and the walls 16 and covering the opening 20 of the compartment 18 creates a natural moisture reservoir when the box 12 is closed. This mositure exists in the air as water vapor. By trapping air in the compartment 18 when closing the box 12 and forming a fluid tight seal against the walls 16, this water vapor is sufficient to prevent premature drying of the paint 32. The construction of the gasket 28 and film 30 laminate can effectively seal the compartment 18 even if dried paint 32 may be built up on the walls of the compartment as shown in FIG. 6.

The artist's box 10 may also include a removable inner tray 42 that contains the paints and can be used as a palette. The tray 42 has side walls 16' approximately at the same height as the outer box side walls 16 and thereby effect a double seal against the gasket. A storage space 44 for brushes and the like can be formed beneath the tray as shown in FIG. 2.

Figure 4:
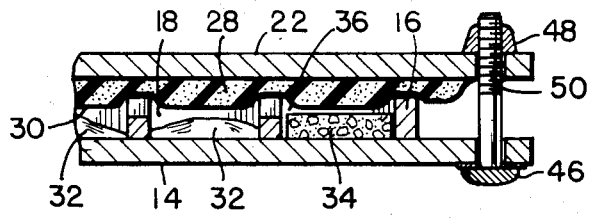
FIG. 4 is a sectional view taken along line 4—4 in FIG. 3.

In a first alternative embodiment shown in FIGS. 3 and 4, the paint box 10 comprises a box 12 and cover held in the closed position by a plurality of bolts 46 and wing nuts 48 disposed around the periphery of the paint box 10 in holes 50 and slots.

Figure 5:
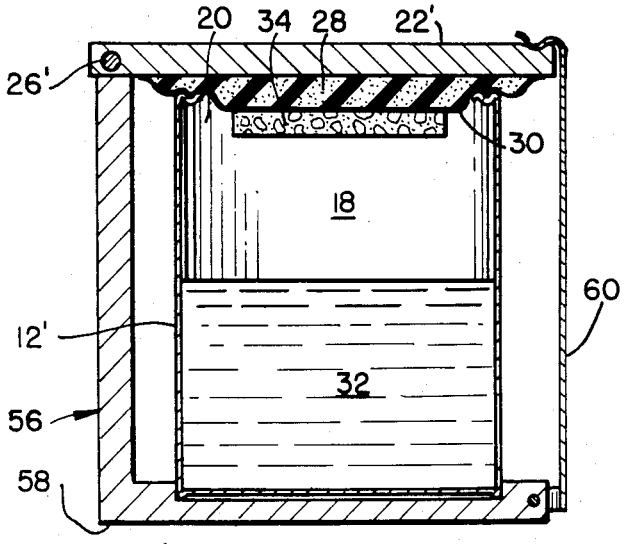
FIG. 5 is a sectional view of another alternative embodiment.

FIG. 5 illustrates a second embodiment where the paint box 12' comprises a paint can set in the base 58 of fixture, 56. Cover 22' pivots at point 26' of the fixture 56 and has the gasket 28, sheeting 30 and reservoir 34 affixed the underside, thereof. The cover 22' is held in a closed position by latch 60. In this way, the paint 32 in the can 12' can be stored to retard the drying.

The compliance of the film covered gasket 30, 28 to the rim of the compartment 28 or can 12' is such that an effective seal can be made even if these surfaces are covered with an uneven and lumpy coating of dried paint 32' as illustrated in FIG. 6 which also shows a paint jar 12'' set within the storage compartment 18.

While preferred and other exemplary embodiments of the invention are illustrated and/or described, it will be understood that the invention is in no way limited to these embodiments.

What is claimed is:

1. In an artist's paint box comprising a bottom wall and vertically extending side walls constructed to define a storage comprtment open only at the top thereof and further comprising a cover having one main surface and constructed to be releasably attachable and movable from an open position to a closed position wherein said one main surface is constructed to superpose said storage compartment and the upper edges of said side walls, the improvement comprising: a storage tray having a planar base and vertical walls extending upwardly from the base to form in said tray a plurality of compartments open only at their tops, means disposed on the side walls for removably supporting the tray in the box with the planar base disposed above the bottom wall and spaced apart therefrom such that the vertical walls of the tray are at substantially the same height as the side walls of the box, a gasket of resilient material completely covering the one main surface of the cover and a non-porous plastic film completely covering the gasket and facing said storage compartment, wherein the gasket is configured to be compressed by the side walls and vertical walls when the cover is in the closed position such that the plastic film coacts with the side walls and vertical walls to fluid-tightly seal the storage compartment from the atmosphere and each of the plurality of compartments from each other and to simultaneously fix the tray in place on the supporting means, whereby the box can be transported by a user without dislocation of the tray in the box or fluid communication between the compartments thereof.

2. The box as recited in claim 1, further comprising a moisture reservoir affixed to the gasket and positionable within the storage compartment when the cover is in the closed position.

3. The box as recited in claim 2, wherein the reservoir comprises an open celled sponge.

4. The box as recited in claim 1, wherein the plastic film comprises polyethylene.

5. The box as recited in claim 1, wherein the storage tray includes at least one paint container in the compartments with side walls having substantially the same height as said vertical walls and engageable with the gasket and film to fluid-tightly seal the top thereof and maintain same in place when the cover is closed.

* * * * *